US006748705B2

(12) United States Patent
Orszulak et al.

(10) Patent No.: US 6,748,705 B2
(45) Date of Patent: Jun. 15, 2004

(54) SLOTTED M-TRACK SUPPORT

(76) Inventors: Leszek Orszulak, 3354 S. 300 Pl., Auburn, WA (US) 98001; Jaroslaw Sydry, 25838 188th Ave., SE., Kent, WA (US) 98042

( * ) Notice: Subject to any disclaimer, the term of this patent is extended or adjusted under 35 U.S.C. 154(b) by 56 days.

(21) Appl. No.: 10/225,219

(22) Filed: Aug. 21, 2002

(65) Prior Publication Data

US 2004/0035065 A1 Feb. 26, 2004

(51) Int. Cl.[7] ..... E04H 9/02; E04C 2/34; E04C 3/30; E04B 2/00

(52) U.S. Cl. ..... 52/167.1; 52/481.1; 52/588.1; 52/730.6; 52/731.7; 52/731.9; 52/733.2

(58) Field of Search ..... 52/167.1, 241, 52/481.1, 481.2, 731.7, 730.6, 731.5, 731.9, 745.09, 745.05, 580, 478, 588.1, 669, 733.2; 108/56.1

(56) References Cited

U.S. PATENT DOCUMENTS 469,520 A * 2/1892 Hale ..... 52/669
3,312,032 A * 4/1967 Ames ..... 52/580
3,345,787 A * 10/1967 Busscher ..... 52/242
3,608,267 A * 9/1971 Curran ..... 52/332
3,950,912 A * 4/1976 Lundberg et al. ..... 52/733.2
3,971,326 A * 7/1976 Svirklys ..... 108/56.1
4,073,110 A * 2/1978 Kennedy ..... 52/302.2
4,137,682 A * 2/1979 Trumper ..... 52/302.3
4,604,842 A * 8/1986 Sukup ..... 52/263
5,127,760 A * 7/1992 Brady ..... 403/230
5,950,385 A * 9/1999 Herren ..... 52/481.1
6,213,679 B1 * 4/2001 Frobosilo et al. ..... 403/403
6,378,256 B1 * 4/2002 Gembala ..... 52/301
6,381,916 B1 * 5/2002 Maisch et al. ..... 52/736.1
6,401,423 B1 * 6/2002 Bergeron et al. ..... 52/733.3
6,612,087 B2 * 9/2003 diGirolamo et al. ..... 52/712
6,647,675 B1 * 11/2003 Castellanos ..... 52/198
6,647,691 B2 * 11/2003 Becker et al. ..... 52/656.1
2001/0004825 A1 * 6/2001 Menendez ..... 52/736.1
2003/0163970 A1 * 9/2003 Moore et al. ..... 52/731.5
2003/0196401 A1 * 10/2003 Surowiecki ..... 52/481.2

* cited by examiner

*Primary Examiner*—Carl D. Friedman
*Assistant Examiner*—Kevin McDermott
(74) *Attorney, Agent, or Firm*—Richard C. Martin

(57) ABSTRACT

A slotted M-shaped support track structure and method in which a M-shaped support track having a planar web and U-shaped flange members and a plurality of slotted openings spaced lengthwise is mounted on the underside of a beam or other overhead building support structure. The plurality of elongated slotted openings are spaced lengthwise and defined by the planar web and adjacent inner legs of the rectangular flange members, and receive perpendicularly related vertical stud members, and thereby allow relative vertical movement between the M-support track and the vertical studs, while holding the studs in place horizontally.

5 Claims, 3 Drawing Sheets

SLOTTED M-TRACK SUPPORT

BACKGROUND OF THE INVENTION

1. Field of Invention

The present invention pertains generally to a building wall support structure and, more particularly, to a seismic wall support structure and method.

In a further and more specific aspect, the present invention concerns a slotted M-shaped support track which is mounted on overhead support structure and which receives vertical studs and allows vertical movement of full-height non-load bearing walls.

2. Description of the Related Art

The use of support structures in framing a building is widely known in the building industry. Many applications exist in which a vertical support member must be connected to a horizontal support member, as for example, where a wall stud meets a ceiling joist, or where a wall stud meets a floor joist. This type of connection commonly requires drilling into the abutting members and fastening a bracket there between to hold the members in assembly. Fastening the members together is time-consuming, labor intensive and difficult to perform in the field. Further, the drilling of holes in the members weakens the members and also introduces difficulty in mounting wall, ceiling, and floor panels. The fastened connections are rigidly connected and do not allow for relative vertical moment of the connected members.

Full-height non-bearing walls which accommodate vertical movement and corresponding support structure is also commonly known. To accommodate movement of an overhead structural member, a flexible connection is employed between the member and the non-bearing wall beneath the member. A downwardly facing channel member with vertical slots in the flanges of the channel member have been utilized to fasten studs of non-bearing walls; however, this method requires fastening member, making the method cumbersome and labor intensive in the field.

SUMMARY OF THE INVENTION

It is therefore an object of the present invention to provide a new and improved wall structure and method which overcome the limitations and disadvantages of wall structures heretofore provided.

It is a further object of the invention to improve the assembly means used to join metal studs in assembly.

Another object of the invention is to eliminate the need for threaded fasteners when connecting two perpendicularly aligned metal beams or studs.

Yet another object of the invention is to provide a wall structure and method of the above character which is resistant to seismic loading.

Another object of the invention is to provide a wall structure and method which can be employed economically and efficiently.

Other objects, aspects and advantages of the present invention will be apparent from the detailed description, considered in conjunction with the drawings, as follows:

These and other objects of the present invention are attained by means of a building support structure containing at least one vertical stud and a M-shaped support track. The stud has a planar web and flanges. The stud is fixedly attached to a lower support or track structure. The stud is inserted into one of the slot openings in the upper M-shaped support track to accomplish a desired spacing of 12, 16, 24 inches on center. Attach drywall as desired to meet the specific hour rating of the wall to the studs, but not attaching to the upper M-shaped support track, thereby allowing vertical movement. The M-shaped track is attached to overhead building structure, using fastening means such as screws or shot pins. The M-shaped support track includes an M-shaped track consisting of a planar web and U-shaped flange members and a plurality of slotted openings. The plurality of slotted openings are spaced lengthwise and defined by the planar web arid adjacent inner legs of the U-shaped flange members. The slotted openings receive the perpendicularly related vertical stud members.

DETAILED DESCRIPTION OF THE PREFERRED EMBODIMENT

Figure 1:
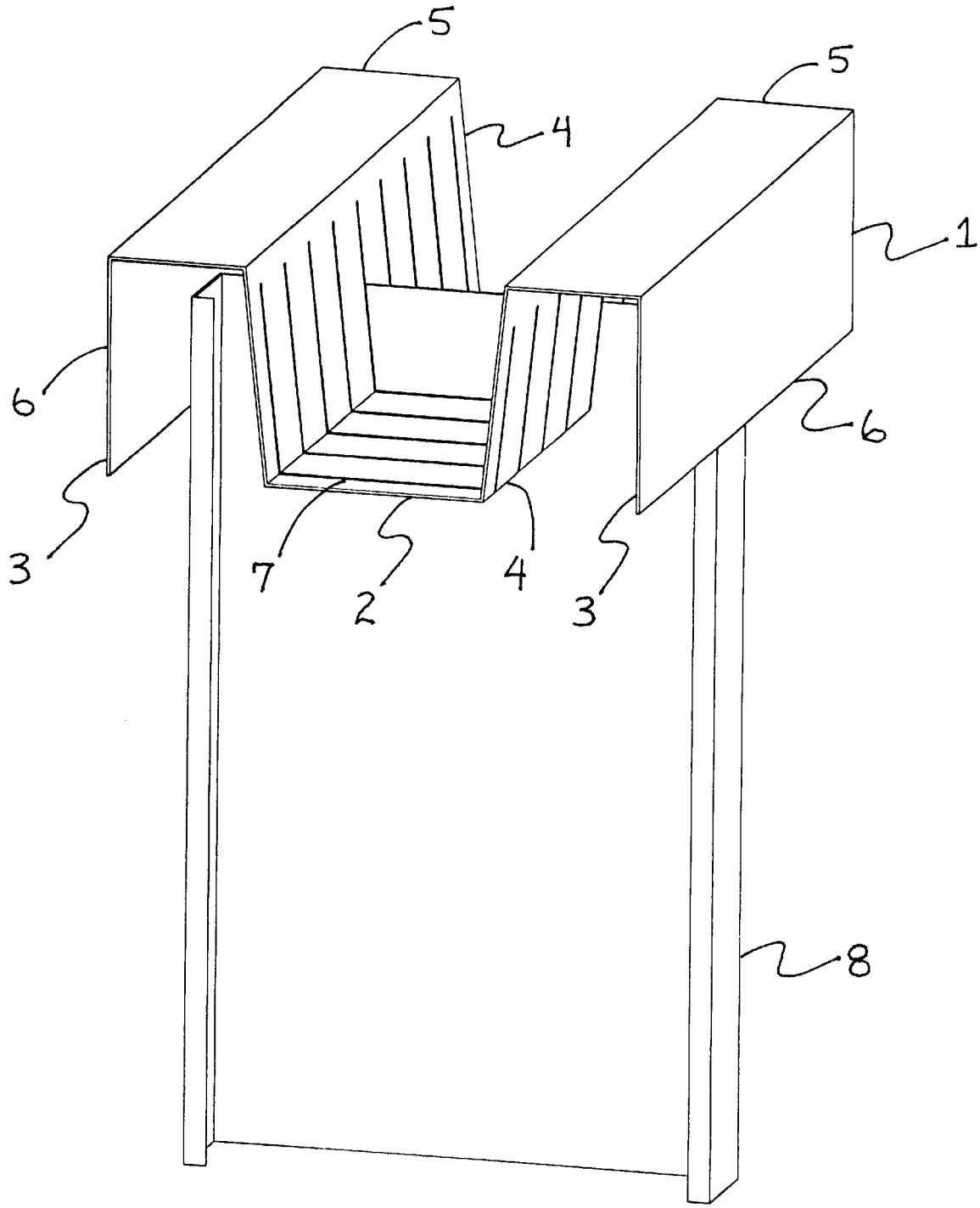
FIG. 1. is a perspective view of the M-shaped support track, with a vertical stud member engaged in an elongated slotted opening.
Figure 2:
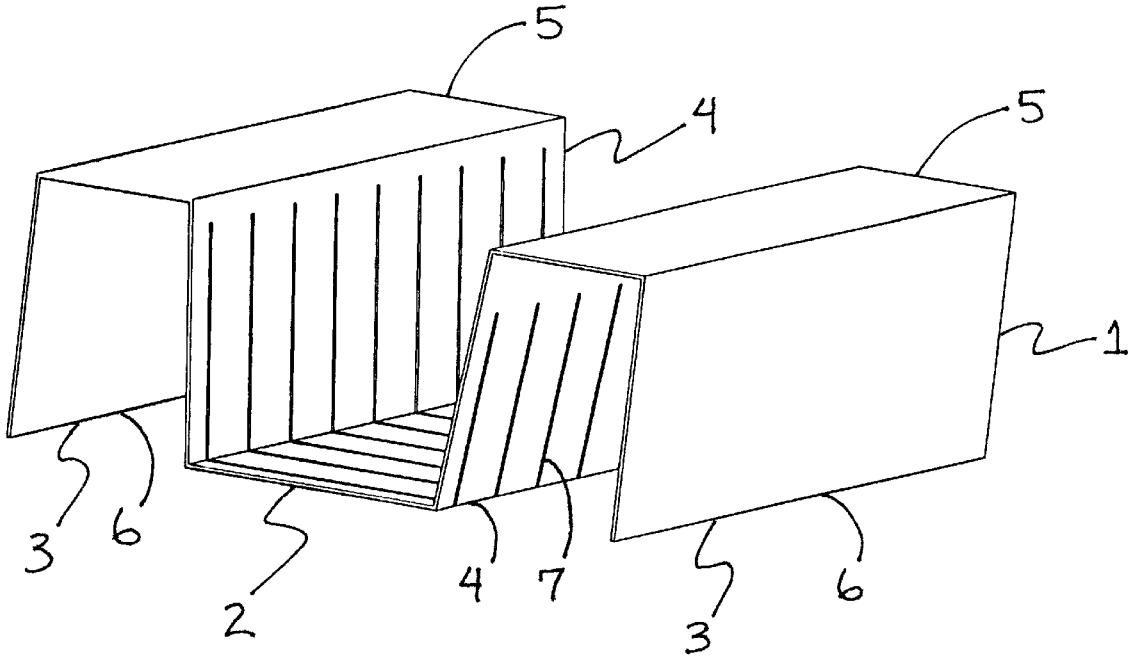
FIG. 2. Is a perspective view of the M-shaped support track.
Figure 3:
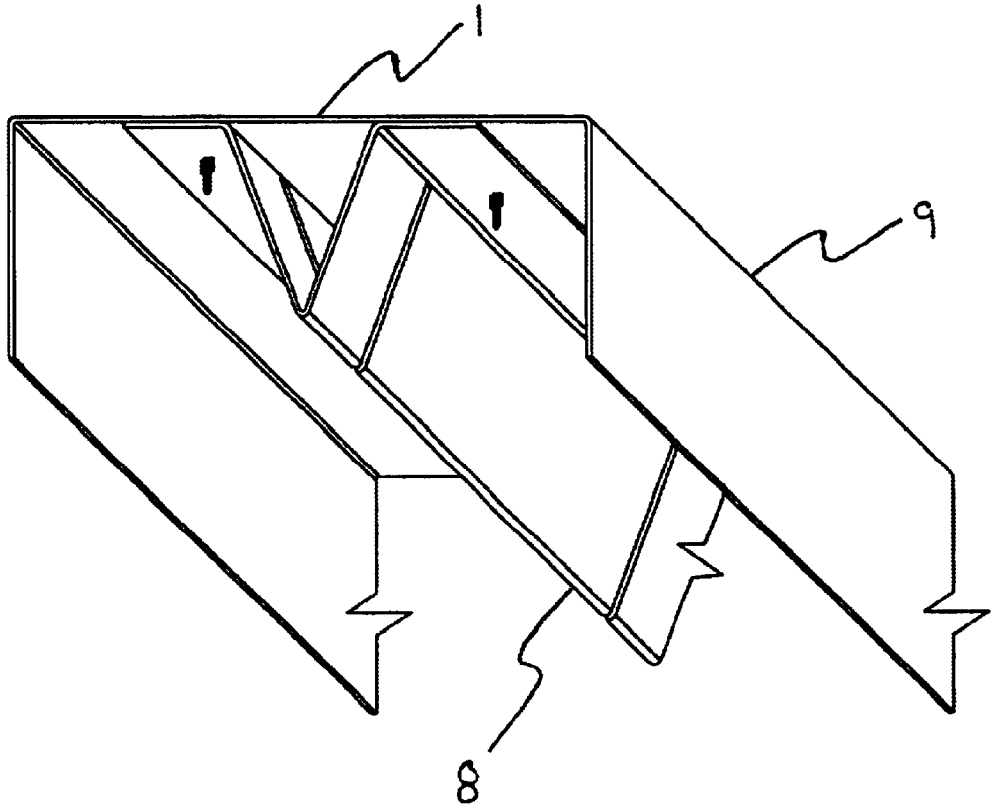

Referring to the drawings, and in particular FIG. 1, there is shown a M-shaped support track 1 comprising a planar web 2 and a pair of U-shaped flanges 3 extending from the planar web 2 defining a M-shape in cross section. The U-shaped flanges 3 comprise an inner leg 4, planar leg 5, and outer leg 6 defining the U-shaped flanges 3. A plurality of horizontally elongated slotted openings 7 are spaced lengthwise on the M-shaped support track 1 and are defined by the planar web 2 and the inner legs 4 of the U-shaped flanges 3.

The M-shaped support track 1 is affixed to overhead building support structure, using fastening means such as screws or shot pins. The M-shaped support track 1 receives perpendicularly related vertical stud members 8. The stud member 8 is fixedly attached to a lower support or track structure. The upper end of the stud member 8 is inserted into and loosely received by a slotted opening 7 in the M-shaped support track 1, and is kept in place by the cross sectional geometry of the same M-shaped support track 1. The cross sectional M-shape of the M-shaped support track 1 provides structural stiffness and strength to anchor the stud member 8 in the horizontal direction, while the loosely received connection permits the freedom of movement in the vertical direction. Thus, relative vertical movement between the studs 8 and the M-shaped support track 1 is permitted to accommodate vertical movement, such as to accommodate seismic loads while anchoring the studs against horizontal movement.

The M-shaped support track 1 is made of a fire resistant material, such as galvanized steel or other fire resistant material commonly known in the building industry. The M-shaped support track 1 is punched, with the elongated slotted openings 7 punched, and brake-formed or roll-formed to achieve the desired M-shaped cross-section. The M-shaped support track 1 is manufactured in standard lengths of ten to twelve feet; however lengths may be varied to accommodate varying installation purposes. The plurality of horizontally elongated slotted openings are 1/16 inch in width which accommodates 16 to 20 gage stud members 8, and are spaced lengthwise on the M-shaped support track 1 at one inch intervals to achieve desired stud spacing of 12, 16, and 24 inches on center. The width and spacing may be varied to accommodate various installation purposes. The M-shaped support track is contemplated to have a cross-sectional height of 2½ inches to 4 inches and width of 2½ inches to 10 inches, and may be varied to accommodate various installation purposes.

An alternate embodiment of the M-shaped support track 1 comprises of shorter lengths of track, having the advantages of location specific, i.e., piece installation at the locations of the studs as needed.

Another embodiment of the M-shaped support track 1 comprises of multiple piece construction of the M-shaped support track. One such multiple piece construction consists of a downwardly facing C-shaped channel member to which a U-Shaped member containing a plurality of elongated slotted openings spaced lengthwise is attached.

The wall structure is constructed by affixing the M-shaped support track 1 to overhead building support structure and perpendicularly related vertical stud members 8 are fixedly attached to a lower support or track structure. The upper end of the stud member 8 is inserted into and loosely received by a slotted opening 7 in the M-shaped support track 1, and is anchored in the horizontal direction by the M-shaped support track 1 cross-sectional geometry. Relative vertical movement between the studs 8 and the M-shaped support track 1 is permitted to accommodate vertical movement, such as to accommodate seismic loads while anchoring the studs against horizontal movement. One or two layers of drywall and as desired to meet the specific hour rating of the wall to the studs, but not attaching to the upper M-shaped support track, thereby allowing relative vertical movement of the wall, resulting a full-height non-bearing wall.

It is apparent from the foregoing that a new and improved wall structure and method have been provided. While this invention has been described in detail with respect to certain preferred embodiments, it should be recognized that the invention is not limited to those embodiments. Rather, many variations and modifications of these would be apparent to those of skill in the art, without departing from the spirit and the scope of the invention, as defined in the appended claims.

The embodiments of the invention in which an exclusive property or privilege is claimed are defined as follows:

1. A seismic resistant wall structure installed between a floor and overhead structure, comprising:

an elongated M-shaped track member affixed to an overhead structure, the M-shaped track member having a planar web and a pair of U-shaped flanges extending from the planar web defining the M-shape in cross-section with the U-shaped flanges having an inner leg, a planar leg, and a outer leg defining the U-shaped flanges;

a plurality of horizontally elongated slotted openings disposed in the planar web and in the inner leg of the U-shaped flanges, and being spaced lengthwise on the M-shaped track member a plurality of stud members extending vertically between the floor and the M-shaped track member with upper ends of the studs extending into the M-shaped track members in alignment with horizontally elongated slotted openings and lower ends fixedly attached to the floor; and fire retardant wallboard moveably attached to the studs, allowing relative vertical movement of the wall.

2. The wall structure of claim 1 wherein the M-shaped track member is fabricated of metal.

3. An elongated M-shaped track member comprising:

a planar web and a pair of U-shaped flanges extending from the planar web defining the M-shape in cross-section with the U-shaped flanges having an inner leg, a planar leg, and a outer leg defining the U-shaped flanges;

a plurality of horizontally elongated slotted openings disposed in the planar web and in the inner leg of the U-shaped flanges, and being spaced lengthwise on the M-shaped track member.

4. The elongated M-shaped track member of claim 3 wherein the track member is fabricated of metal.

5. An elongated M-shaped track member comprising:

a channel member having a web with two ends and a leg extending from each end in a direction away from the web, and a flange extending from a terminal end of each leg in a direction away from the web;

the channel being disposed within a C-shaped channel; and the channel member includes a plurality of elongated slotted openings, disposed in the web and in each leg, spaced lengthwise on the channel member.

* * * * *